United States Patent [19]

Dischler et al.

[11] Patent Number: 4,631,788

[45] Date of Patent: Dec. 30, 1986

[54] APPARATUS FOR MECHANICALLY CONDITIONING TEXTILE MATERIALS

[75] Inventors: Louis Dischler; Wolfgang K. F. Otto, both of Spartanburg, S.C.

[73] Assignee: Milliken Research Corporation, Spartanburg, S.C.

[21] Appl. No.: 768,814

[22] Filed: Aug. 23, 1985

[51] Int. Cl.[4] ..... D06C 19/00; D06C 15/14

[52] U.S. Cl. ..... 26/25; 26/27

[58] Field of Search ..... 26/25, 26, 27

[56] References Cited

U.S. PATENT DOCUMENTS

| | | | |
|---|---|---|---|
| 87,330 | 3/1869 | Eaton . | |
| 300,964 | 6/1884 | Garnier . | |
| 373,193 | 11/1887 | Rau . | |
| 502,903 | 8/1893 | Fries . | |
| 1,181,799 | 5/1916 | Morley | 26/25 |
| 1,555,865 | 10/1925 | McConnell | 26/27 |
| 2,187,543 | 1/1940 | Haskin . | |
| 2,196,256 | 4/1940 | Dreyfus et al. | 26/25 X |
| 2,450,847 | 10/1948 | Wilson | 26/25 UX |
| 2,466,348 | 4/1949 | Ambye . | |
| 2,629,918 | 3/1953 | Swing | 26/25 X |
| 2,706,845 | 4/1955 | Swan . | |
| 2,730,113 | 1/1956 | Hadley | 26/25 X |
| 2,972,177 | 2/1961 | Bidgood, Jr. . | |
| 3,124,844 | 3/1964 | Constantine et al. . | |
| 3,408,709 | 11/1968 | Reitz | 26/27 X |
| 3,523,346 | 8/1970 | Bolen et al. . | |
| 3,894,318 | 7/1975 | Ito et al. . | |

FOREIGN PATENT DOCUMENTS

| | | | |
|---|---|---|---|
| 0067670 | 12/1982 | European Pat. Off. | 26/25 |
| 102523 | 12/1923 | Switzerland | 26/25 |

*Primary Examiner*—Robert R. Mackey

*Attorney, Agent, or Firm*—Earle R. Marden; H. William Petry

[57] ABSTRACT

Method and apparatus to subject the face and back side of a fabric to successive impacting by a plurality of flaps to break up the fiber or filament bond thereof and increase the yarn-to-yarn mobility therein. The fabric is supplied at an angle to the impacting flaps and the flaps do not compact the fabric therebetween and cause a streak or lie therein.

6 Claims, 7 Drawing Figures

APPARATUS FOR MECHANICALLY CONDITIONING TEXTILE MATERIALS

Figure 1:
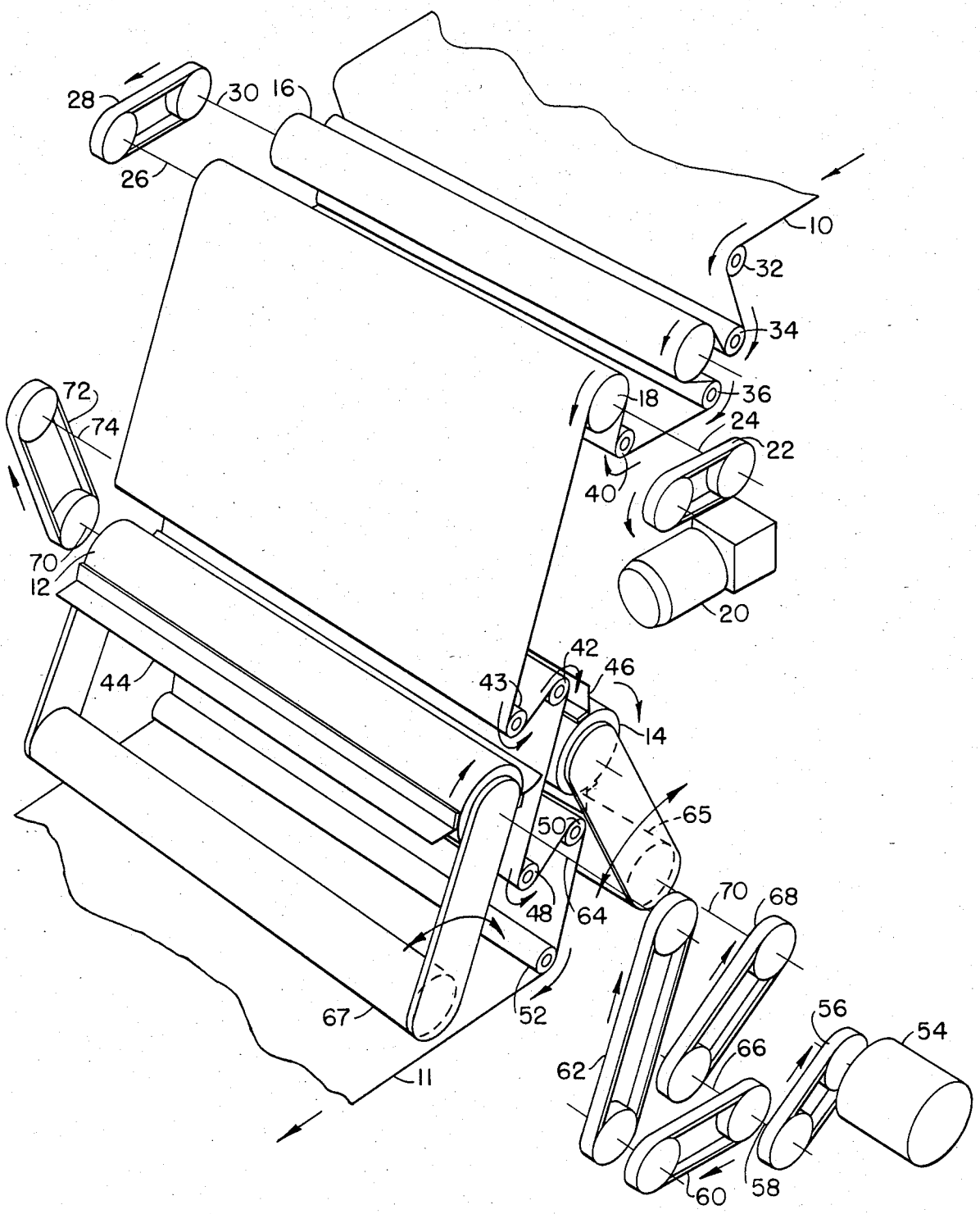

This invention relates to a method and apparatus for mechanically conditioning textile materials and more particularly to a method and apparatus for treating textile materials to soften them and to provide them with a fuller hand without significantly adversely affecting either the surface of the material or its strength characteristics.

Textile materials, such as fabrics, may be characterized by a wide variety of complex functional and aesthetic characteristics which determine commercial success or failure of the material. Examples of typical functional characteristics of a material which may be regarded as important in the textile arts include strength, abrasion resistance, stretch, soil repellence, soil release, water and oil repellence, moisture absorption and moisture regain, etc. Typical aesthetic characteristics of a textile material which may be considered in its evaluation for a particular end use are color, pattern, texture, fabric "surface feel" and "hand." It is perhaps the latter two, difficult-to-define, aesthetic characteristics with which the subject matter of the present invention is most directly and clearly concerned; however, modification of those characteristics of a fabric may affect other functional or even aesthetic characteristics in a positive or negative way, and consequently, there may be occasion throughout this disclosure where reference to those other related and interdependent characteristics of a textile material may become relevant, requiring some discussion.

Concerning characteristics of a textile material which are most significant with regard to the process and apparatus of the present invention, namely those of fabric surface feel or hand, any quantification of those characteristics in manageable, easily understood terms has been largely unsuccessful. Out of necessity the art has developed a range of descriptive, subjective terms, which are understood and which convey highly relevant information to those skilled in the textile arts. Some terms which have been used to describe fabric hand include: light, heavy, bulky, stiff, soft, harsh, full, silky, papery, thin, raggy, and so forth.

The hand of a textile material, such as a fabric, is determined by the particular raw materials used in its construction, the size and shape of the fibers employed, fiber surface contour, fiber surface frictional characteristics, yarn size, type, e.g., filamentary or spun, construction of the fabric, e.g., woven, knit, fabric weight, by the chemical finishes applied to the fabric, such as softeners, and by the processing history, including any mechanical working of the fabric. It is the last mentioned technique, that of mechanical working of the fabric, with which the process and apparatus of the present invention is most directly concerned.

A variety of techniques, some of which are used commercially today, are known in the textile art for mechanically conditioning textile sheet materials to change their aesthetic qualities. Such techniques include fulling techniques, Sanforizing, rubber-belting, jet rope scouring, and the technique of overfeeding the material on the tenter frame. The technique of mechanically impacting or beating textile materials, the general type of mechanical technique with which the present invention is concerned, has also been known for many years. Such techniques have been disclosed, for instance, as early as the late 1800's in U.S. Pat. Nos. 87,330 and 373,193. The use of flexible beating means such as thongs inserted in a shaft or tube for improving the appearance of a wide variety of materials including textile materials is also known as disclosed, for instance, in U.S. Pat. No. 2,187,543. It is further known that both the face of the textile material and the back thereof may be simultaneously subjected to mechanical impact with an impact means. Such a technique is disclosed in U.S. Pat. No. 1,555,865. Exemplary of the more recent patent art on the subject of mechanical conditioning of textile materials is the so-called "button breaker" technique which is disclosed, for instance, in U.S. Pat. No. 3,408,709.

All of the presently known techniques for mechanically finishing textile materials, however, suffer from one or more significant disadvantages. In certain instances, the effect achieved may not be sufficiently significant to justify the additional processing step involved. The technique may not be performable on a continuous basis, or it may be so severe that it produces one or more undesirable effects upon other functional and/or aesthetic characteristics such as significant breaking of surface fibers or undue weakening of the overall strength of the textile material. It would thus be very desirable to provide a process and apparatus which can be employed to treat textile sheet materials continuously to achieve a desirable conditioning of the material, especially the hand thereof, while minimizing or eliminating undesirable effects upon other commercially important aesthetic and functional characteristics.

The present invention also relates to an apparatus by means of which the above-described method may be performed. Such apparatus comprises means for moving a textile sheet material, means for intermittently subjecting successive adjacent sections of both the face and back of the material across the entire width of the material to impact and friction with flexible impact means. Preferably, the construction of the impact means and positioning thereof relative to the material should be such as to maximize the shearing and scraping action applied thereto.

According to an embodiment of the invention, the textile material may be heated above ambient temperature at the time of impact with the impact means. Such heating step may be performed at or just prior to impact. Typically, for a thermoplastic material, the material may be heated to a temperature just above the glass transition temperature of the material at the time of impact with the impact means.

In another embodiment of the apparatus and process, heating of the material may be performed, for instance, on a non-heat set material just after impacting with said impact means but preferably prior to the application of any substantial pressure or stretching forces to the material.

In yet another embodiment, a chemical may be applied to the textile material in an amount sufficient to enhance or change the effect achieved by means of the mechanical impacting step. Thus, for instance, where the textile material is made predominantly of a polymeric material, the chemical may be a plasticizer for the polymeric material.

In general, the phrases "mechanical conditioning" or just "conditioning" as used herein refers to a change of fabric hand or other related or separate fabric characteristics such as bulk, fullness, softness, drape and thickness. The specific conditioning effect achieved may depend, not only upon the process and apparatus variables, such as impact and shearing forces applied to the fabric, but also upon the character and construction of the textile material per se. Examples of such materials include pile fabrics, woven, knit, non-woven fabrics, as well as coated fabrics and the like. Examples of knit fabrics include double knits, jerseys, interlock knits, tricots, warp knit fabrics, weft insertion fabrics, etc. Woven fabrics may be plain weaves, twills or other well-known constructions. Such fabrics may be constructed from spun or filament yarns or may be constructed by using both types of yarns in the same fabric. Fabrics made from natural fibers such as wool, silk, cotton, linen may also be treated, although the preferred fabrics are those made from synthetic fibers such as polyester fibers, nylon fibers, acrylic fibers, cellulosic fibers, acetate fibers, their mixtures with natural fibers and the like.

A particularly noticeable and desirable softening effect upon textile materials has been observed in a preferred embodiment on resin finished fabrics made from a comparatively "open" construction, such as those having "floats," e.g., twills. Resin finished fabrics made from low twist spun yarns may be particularly desirable to treat according to the invention, especially if they are also characterized by open construction. While the significant effect upon such materials has been observed repeatedly, it is not fully understood why such effect is particularly desirable in such instances. It is believed, however, with regard to such materials (although the invention is not to be limited to any such theory of the mechanism involved) that such desirable results ensue because of one or more of the following factors:

1. Comparatively easy access of the impact means to construction elements of the fabric;
2. Fracturing of fiber-to-fiber and yarn-to-yarn resin bonding due to the action of the compressive and shear forces applied to the material;
3. Significant relative mobility of yarns and fibers upon application of shear forces to the material; and
4. Potential for enhanced surface smoothness of the material due to the scraping action of the impact means.

Another of the wide variety of conditioning effects that may be achievable by means of the process and apparatus of the present invention has been observed where range dyed fabrics are processed according to the invention. In this regard, it has been observed that continuous dyeing, that is range dyeing of fabrics, especially spun, polyester-cotton greige fabrics and polyester filament-containing fabrics, typically may provide products characterized as having a thin, papery, stiff and harsh hand. Commercial acceptability of such fabrics has thus frequently required application of a chemical softener to it to improve the hand characteristics. These softeners, however, may add undesirably to the cost of the final product; and they may wash out of the fabric, especially after repeated laundering. Jet dyeing of the identical greige fabric, which is a more expensive batch-type operation, by contrast, may provide a product having a very desirable smooth and full hand as well as good drape characteristics. Processing of such range dyed fabrics according to the present invention, however, may provide products having hand characteristics that are very similar, if not indistinguishable, from the corresponding jet dyed products.

In yet another embodiment, it has been observed that the dimensions of certain fabrics may actually be caused to change in a desirable way. For instance, it has been observed that some fabrics may be caused to shrink upon being processed according to the invention in the length and/or the width direction resulting in a change of the weight of the fabric per unit area. Furthermore, even if the fabric is stretched again to its original length and/or width and returned approximately to its original weight per unit area, the fabric may be characterized as having a fuller, bulkier hand.

In another embodiment, the process has been found to have a very desirable effect on the appearance and surface feel of a wide variety of pile fabrics, such as tufted fabrics, plushes, velvets and the like. When employed on tufted fabrics such as, e. g.,upholstery fabrics, the process may accomplish an untwisting and "opening up" or separation of the fibers in the tufted yarns giving the resulting product a much fuller, much more uniform appearance. Such processing may also provide a much more desirable, softer, silkier, more luxurious surface feel to the fabric. On velvet fabrics, an enhancement of the fabric surface luster has been observed. Another desirable effect of the use of the process on pile fabrics may be the removal of undesired fiber fly and other loose materials entrapped in the pile.

In a further embodiment, polyester filament fabrics may lose their undesirable "plastic-like" feel and the hand of such fabrics may become more similar to fabrics made entirely from natural fibers such as wool or cotton.

Other objects and advantages of the invention will become readily apparent as the specification proceeds to describe the invention with reference to the accompanying drawings in which:

FIG. 1 is a perspective view, partially in schematic, of the preferred apparatus of the invention and FIGS. 2–7 are schematic representations of the sequential action of the flaps on the fabric to be treated.

Looking now to the drawings and especially FIG. 1, the preferred form of the invention is shown where the fabric 10 to be conditioned is supplied from a supply roll, not shown, in a generally downward direction. It is understood that the fabric 10 can be delivered in a vertical direction and/or in a generally horizontal direction so long as the parameters set forth herein are met.

The fabric 10 is delivered to the flap rolls 12 and 14 by the drive rolls 16 and 18 which are driven by the motor 20 through belt system 22, shaft 24, shaft 26, belt system 28 and shaft 30. In its path of travel to the flap rolls 12 and 14, the fabric 10 passes over idler rolls 32, 34, 36 and 40; a fixed roll 42 with a threaded surface to remove the wrinkles in the fabric and an idler roll 43. After being treated by the flaps 44 in the flap roll 12 and the flaps 46 in the flap roll 14, the treated fabric 11 is delivered to a take-up roll (not shown) over, sequentially, the scroll roll 48 and the idler rolls 50 and 52.

The flap rolls 12 and 14 are both driven in the clockwise direction by a suitable motor 54. The roll 12 is driven by the motor 54 through belt system 56 connected to the shaft of the motor, shaft 58, belt system 60, belt system 62 and shaft 64. Flap roll 14 is driven off the belt system 60 via shaft 66, belt system 68, jack shaft 70, which extends across the machine to the belt system 72 and shaft 74. The flap rolls are mounted to pivot tubes 65 and 67 by which they can be rotated to engage the fabric.

The flaps 44 and 46 may be made of a wide variety of suitable reinforced or non-reinforced materials such as neoprene rubber, urethane, polyvinyl chloride, nylon, and other sheet materials as well as composites thereof of sufficient durability and flexibility to accomplish the desired result. In the preferred form of the invention, there are two flaps 44 and 46 bolted or otherwise secured to the flap rolls 12 and 14, respectively, extending outward therefrom spaced diametrically opposite to one another on each roll and 90° out of phase with flaps on the other cooperating roll. It is understood that a multiplicity of flaps (N) can be used and the spacing of the flaps on the roll shall be 360°/N from one another and 180°/N out of phase with the corresponding flaps on the other roll.

Looking now to FIGS. 2–7, it should be noted that the fabric to be treated is introduced to the flap rolls 12 and 14 in a plane containing a line parallel to and approximately midpoint between the axes of flap rolls 12 and 14 and rotated through a small angle from the perpendicular to the plane defined by the axes of the flap rolls and in the direction of rotation thereof. It has been found that this angle is necessary to obtain maximum surface effect on the fabric 10 without a deleterious effect on the construction of the fabric such as corrugations, mark-off, yarn distortions, etc.

When in operation, flap rolls 12 and 14 rotate and the distance between the flap rolls is adjusted so that in the absence of material 10 the flaps would impinge upon each other to a predetermined depth of the flaps if they were in phase. When the machine is operating and threaded up with material 10, flaps 44 and 46 will be extended substantially radially by centrifugal force from the rapidly rotating rolls 12 and 14 and will intermittently and alternately impact the material with considerable force. Of course, the flaps which are impacting the material will be deflected from their radial extension as a result of such impact.

It should be noted that while FIG. 1 illustrates only one treatment station, the actual apparatus may include one station or alternatively two or more stations, e.g., three, four or even more stations may be provided on the apparatus for treatment of the material.

In co-pending U. S. patent application Ser. No. 654,029, filed Sept. 24, 1984, the number of flaps and the length thereof was so selected that spaced portions of the fabric were trapped between flaps of each of two cooperating flap rolls. This treatment, while it provided the necessary treatment on the back and the front of the fabric, had the disadvantages of excessive flap wear, resulting in high service expense and down time, and occasionally the creation of lines across the surface of the fabric where compacted by the compression between the flaps. These disadvantages, though greatly outweighed by the advantages for a number of styles of fabric, did result in lowered efficiency and higher costs on other styles of fabric. To overcome these disadvantages, the number of flaps, the location of same, the angle of introduction of the fabric and the cooperation of the flaps and the fabric as shown in FIGS. 2–7 was employed.

Figure 2:
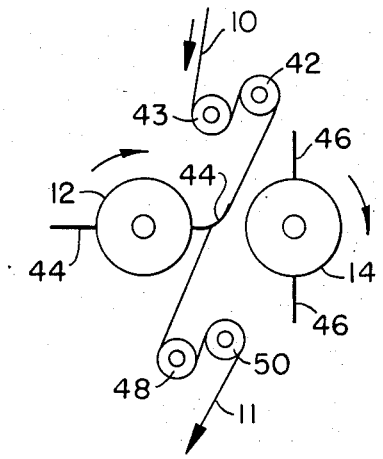
Figure 3:
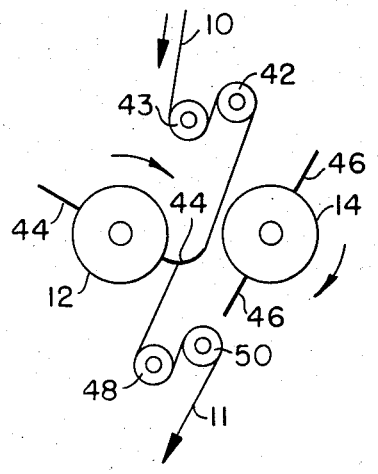
Figure 4:
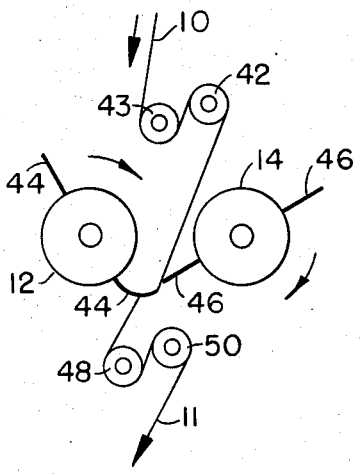
Figure 5:
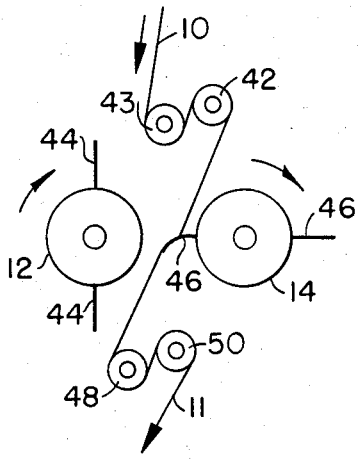
Figure 6:
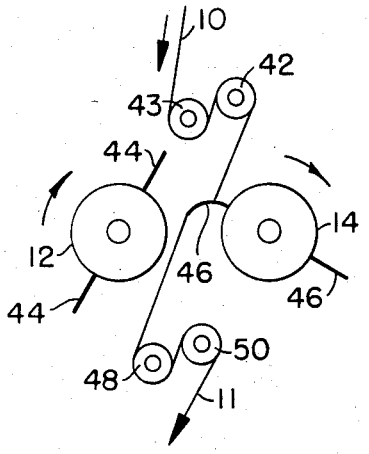
Figure 7:
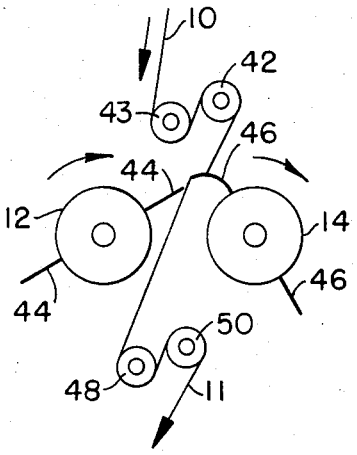

In FIG. 2, one of the flaps 44 of the roll 12 is engaging one surface of the fabric 10 while one of the flaps 46 of the roll 14 has just disengaged the other side of the fabric 10. As the rolls 12 and 14 continue to rotate in the clockwise direction, the flap 44 is pushing the fabric 10 towards the roll 14 while working the surface thereof and the other flap 46 on the roll 14 is rotating into fabric contacting position (FIG. 3). In FIG. 4, the flap 44 has pushed the fabric towards the roll 46 while the tip of the flap 46 on the roll 14 has engaged the opposite side of the fabric 10 at a point just above and adjacent the contact point of the flap 44 so that the fabric 10 is not trapped therebetween. Then FIGS. 5–7 indicate the action of the flap rolls 12 and 14 as they continue to rotate, showing the action of the opposite flaps 44 and 46 in the same manner as indicated in FIGS. 2–4 except acting on the opposite side of the fabric 10 to bring the flap rolls 12 and 14 into the repeat position of FIG. 2. Since the angular tip of the flap rolls is at least twenty times the linear velocity of the fabric 10 and the flaps extend across the width of the fabric, substantially all the surface area of both sides of the fabric has been repeatedly impacted and sheared by the action of the flaps thereon.

According to the process of the present invention, the material is ordinarily extended to its open width and may preferably be moved in the warp or longitudinal direction. The mechanical impact may be described as being of a force and frequency sufficient to cause a substantially uniform modification of the material. As will be apparent to those skilled in the art, the extent of modification of the material, the specific effects obtained, and the rate at which these effects may be obtained will depend upon the operating parameters of the machine used in the process and the nature of the material being treated. Relevant operating parameter include, for instance, force and frequency of impact, fabric tension, friction between flap and fabric surfaces and even the linear speed of the material relative to the impact means. Some or all of these parameters are in turn a function of the radius of the flap roll, flap length, bending modulus of the flaps, thickness and density of the flaps, the speed of rotation of the flap rolls, and the surface characteristics of both the flaps and the fabric. In general, it has been found that the flap tip velocity will be from 5,000 to about 20,000 ft./min. The linear speed of the material relative to the impact means may vary from about 15 feet to about 750 feet per minute, and will preferably be between about 60 and about 360 feet per minute, depending upon the number of treatment stations available, the type of material and intensity and character of the treatment desired.

EXAMPLE

A precure, permanent press, soil release, finishing formulation containing carbamate resin, polymeric acrylic acid-based soil release agent, a combination of moderate amounts of high density polyethylene and polycondensate softening agents was applied to a white, plainweave, polyester/cotton fabric from 65/35 percent spun polyester/cotton 25.0/1 warp and a 20.5/1 fill yarn. After drying and curing of the finish the fabric which weighed approximately 5 ounces per square yard was treated in one pass at 90 yards per minute according to the process of the invention using the apparatus described in FIG. 1.

As to the specific processing specifications employed, the flap roll diameter was 10 inches. The length of the flaps extending from the roll was 3 inches. There were two flaps attached to each roll and the flaps were constructed from 3 ply fabric reinforced red neoprene rubber. The "fabric free" length, that is the distance between the scroll rolls over which the fabric travels above and below the flap roll positions was 30 inches. The preferred angle that the plane of the fabric makes with the vertical is approximately 10° . Fabric tension was about 100 pounds (1½ lbs./inch of fabric width).

The flap rolls were rotated at 1780 rpm with both flap rolls rotating in the clockwise direction.

After processing, it was observed that the fabric had acquired a softer, warm, supple and much lighter hand. Upon analysis by the KES-F system, the rigidity in bending was found to have decreased from 119 to 70 gram force $cm^2/cm$ and the stiffness in shear was found to have decreased from 47 to 22 gram force/cm degree. Fabric weight remained substantially unchanged. It was apparent from the tests which were conducted on the textile material that, in addition to increasing the fiber-to-fiber and yarn-to-yarn mobility of the fabric, the treatment resulted in substantial "loosening up" and fulling of the fabric structure.

It is obvious that an apparatus and method to mechanically condition a textile fabric has been described which increases the fiber-to-fiber and yarn-to-yarn mobility of the fabric resulting in a softer hand and more body without causing fabric defects. Furthermore, the described method and apparatus is more efficient and requires less down time for replacement of the flaps due to excessive wear.

Although the preferred embodiment has been described in detail, it is contemplated that many changes may be made without departing from the scope or spirit of the invention and we desire to be limited only by the claims.

We claim:

1. Apparatus to mechanically soften a textile fabric comprising: a frame, a first flap roll rotatably mounted in said frame, a second flap roll spaced from said first flap roll and rotatably mounted in said frame, each of said flap rolls having at least two flaps connected thereto and extending outwardly therefrom, said flaps in each roll being out spaced from one another and out of phase with the corresponding flaps on the other of said flap rolls, a first fabric guide roll mounted on one side of said flap rolls to guide fabric between said flap rolls, a second fabric guide roll on the other side of said flap rolls to guide fabric away from said flap rolls, all of said rolls being mounted so that a plane through the axis of rotation of said guide rolls will cross at an angle from the perpendicular to a plane passing through the axis of rotation of said flap rolls, means to supply a fabric to be softened from said first fabric guide roll to said second fabric guide roll between said flap rolls and means connected to said flap rolls rotate both of said flap rolls in the same direction and at a greater velocity than the linear velocity of the fabric and to cause the flaps on each of said flap rolls to successively impact and shear the fabric being passed therebetween, a flap of one flap roll contacting one side of the fabric just after a flap on the flap other roll has released contact with the opposite side of the fabric passing between said flap rolls.

2. The apparatus of claim 1 wherein said flaps on one flap roll are located diametrically opposite to the other flaps on the other flap roll.

3. The apparatus of claim 2 wherein said corresponding flaps on said rolls are approximately 90° out of phase with one another.

4. The apparatus of claim 3 wherein said flaps on each roll are of a length that they would overlap if rotated to a position where they faced one another.

5. The apparatus of claim 1 wherein said flaps on each roll are located 360°/N from one another and 180°/N out of phase with the corresponding flaps on said other roll wherein N represents the the number of flaps.

6. The apparatus of claim 5 wherein said flaps on each roll are of a length that they would overlap if rotated to a position where they faced one another.

* * * * *